US010495410B2

(12) United States Patent
Tedder et al.

(10) Patent No.: US 10,495,410 B2
(45) **Date of Patent: *Dec. 3, 2019**

(54) BACKER LATCH ATTACHMENT

(71) Applicant: Tedder Industries, LLC, Post Falls, ID (US)

(72) Inventors: Thomas Tedder, Post Falls, ID (US); Jacob Shearer, Post Falls, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/132,682

(22) Filed: Sep. 17, 2018

(65) Prior Publication Data

US 2019/0017778 A1 Jan. 17, 2019

Related U.S. Application Data

(62) Division of application No. 15/818,567, filed on Nov. 20, 2017, now Pat. No. 10,119,783.

(60) Provisional application No. 62/424,666, filed on Nov. 21, 2016.

(51) Int. Cl.
*F41C 33/02* (2006.01)
*F41C 33/04* (2006.01)

(52) U.S. Cl.
CPC ..... *F41C 33/041* (2013.01); *F41C 33/048* (2013.01); *F41C 33/02* (2013.01); *F41C 33/0209* (2013.01); *F41C 33/0236* (2013.01); *F41C 33/04* (2013.01)

(58) Field of Classification Search
CPC ..... F41C 33/0209; F41C 33/0236; F41C 33/0245; F41C 33/04; F41C 33/048; A45F 2200/0591
See application file for complete search history.

(56) References Cited

U.S. PATENT DOCUMENTS

| | | | | |
|---|---|---|---|---|
| 7,739,824 | B1 * | 6/2010 | Swan | F41G 11/003 42/124 |
| 9,744,717 | B2 * | 8/2017 | Miller | B29C 61/02 |
| 10,030,934 | B2 * | 7/2018 | Metayer | F41C 33/0209 |
| 10,119,783 | B2 * | 11/2018 | Tedder | F41C 33/041 |
| 10,126,096 | B2 * | 11/2018 | Schweitzer | F41C 33/0209 |
| 10,295,305 | B2 * | 5/2019 | Tedder | F41C 33/0263 |
| 2006/0226185 | A1 * | 10/2006 | Har-Shen | F41C 33/0209 224/244 |
| 2007/0181619 | A1 * | 8/2007 | Seyfert | F41C 33/0227 224/196 |
| 2015/0034684 | A1 * | 2/2015 | Tedder | A45F 5/00 224/242 |
| 2016/0216065 | A1 * | 7/2016 | Tedder | F41C 33/0263 |
| 2017/0010066 | A1 * | 1/2017 | Miller | B29C 61/02 |
| 2017/0227324 | A1 * | 8/2017 | Metayer | F41C 33/0209 |

(Continued)

*Primary Examiner* — Justin M Larson

(74) *Attorney, Agent, or Firm* — Timberline Patent Law Group

(57) ABSTRACT

Representative implementations of devices and techniques provide a backer latch attachment system for various field-adaptable holster arrangements (such as for handgun holsters, for example). In the implementations, the backer latch attachment may be used to couple various carrier components together and/or to a holster backer to form holsters in various configurations. In various embodiments, the backer latch attachment includes a male latch support arranged to receive and to support a feature of the carrier and a female lock cover arranged to trap the feature to the male latch support.

20 Claims, 7 Drawing Sheets

(56) References Cited

U.S. PATENT DOCUMENTS

| | | | | |
|---|---|---|---|---|
| 2017/0231372 | A1* | 8/2017 | Metayer | F41C 33/046<br>224/222 |
| 2018/0135939 | A1* | 5/2018 | Tedder | F41C 33/0209 |
| 2018/0142988 | A1* | 5/2018 | Tedder | F41C 33/0236 |
| 2018/0142990 | A1* | 5/2018 | Tedder | F41C 33/041 |
| 2018/0202765 | A1* | 7/2018 | Tedder | F41C 33/048 |

* cited by examiner

BACKER LATCH ATTACHMENT

PRIORITY CLAIM AND CROSS-REFERENCE TO RELATED APPLICATION

This application is a divisional of U.S. patent application Ser. No. 15/818,567 filed Nov. 20, 2017, which claims the benefit under 35 U.S.C. § 119(e)(1) of U.S. Provisional Application No. 62/424,666, filed Nov. 21, 2016, both of which are hereby incorporated by reference in their entirety.

BACKGROUND

Implements, such as tools, weapons, and the like, may be temporarily encased in a carrier (such as a holster, for instance) for protection of the implement and/or the user, while providing access to the implement. For example, a carrier may allow a user to conveniently carry the implement, safely retaining the implement until needed. When the implement is to be used, the user may withdraw the implement from the carrier, and then return it to the carrier when finished. In some cases, such as with a handgun for example, the holster may allow the user to conceal the implement, or to conceal the fact that the user is carrying the implement.

In the case of a handgun, the holster should reasonably protect the handgun and the user, and should be convenient to the user for ready use. Accordingly, the holster should retain the handgun until it is to be used, but allow the user to draw the handgun for use without undue effort or difficulty. The holster should be rigid and stable enough to allow the handgun to be repeatedly drawn and re-holstered, usually with the same hand. However, the holster should also be versatile enough to be comfortably carried by the user, such as when it is worn on the person of the user for an extended length of time.

In many circumstances it can be desirable to have more than one holster configuration for a handgun or other implement. For example, at different times it may be desirable to have one holster configured for outside-the-waistband (OWB) carry, another holster configured for inside-the-waistband (IWB) carry, still another holster for shoulder carry, an additional holster for ankle carry, and so forth, often for the same handgun. The desire for multiple holster configurations can be further compounded for multiple handguns (or implements).

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Overview

Figure 1:
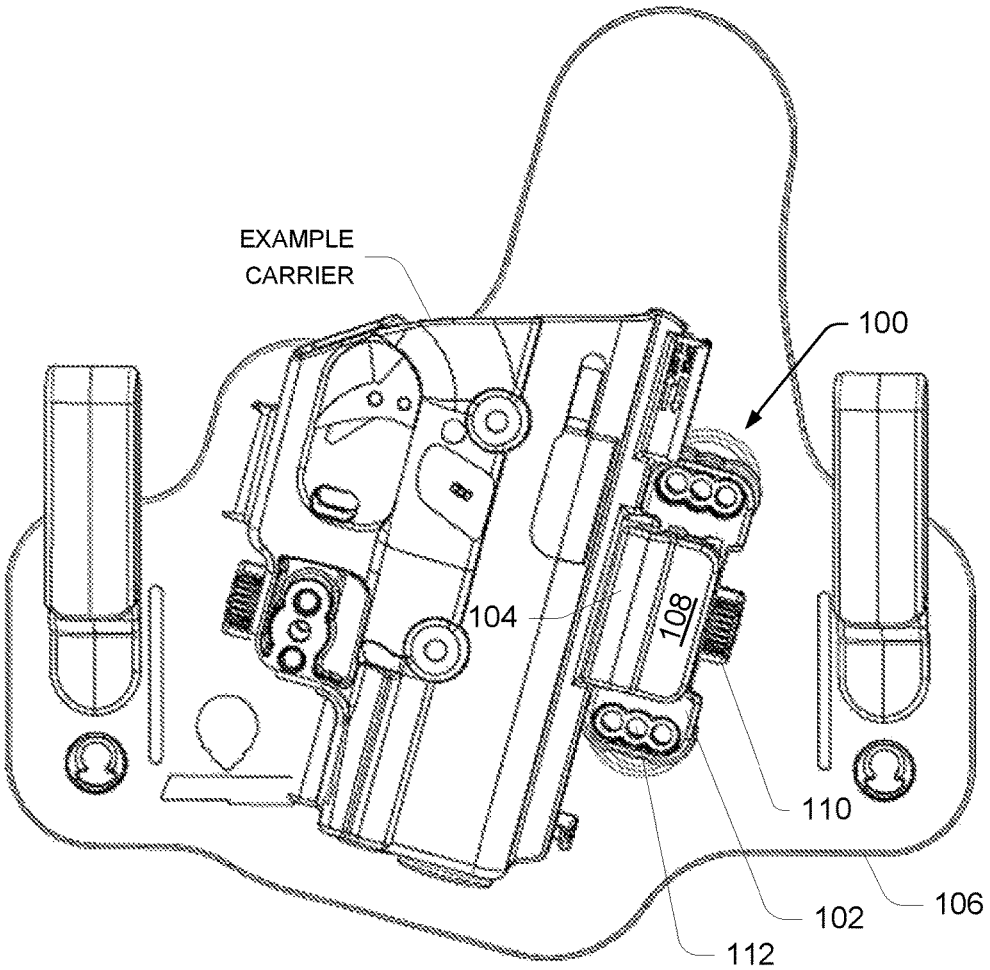
FIG. 1 shows a front view of an example holster configuration, with an example backer latch attachment, according to an implementation.
Figure 2:
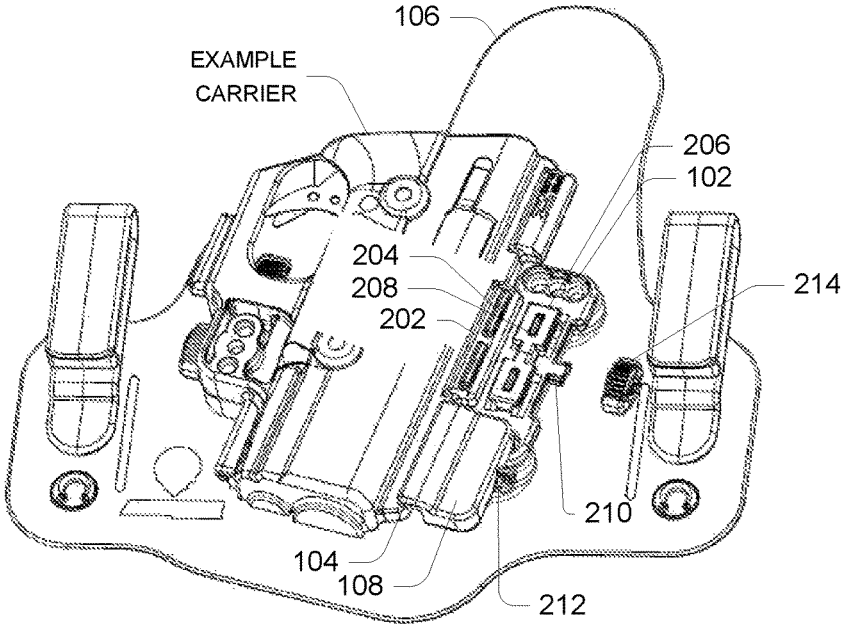
FIGS. 2 and 3 show a partially expanded view of the example holster configuration of FIG. 1, according to an implementation.
Figure 3:
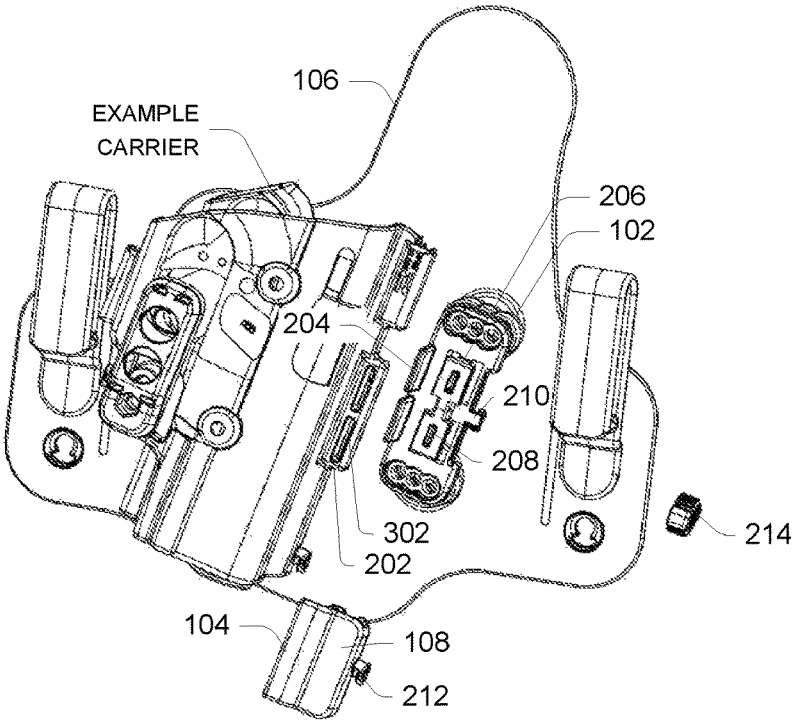
Figure 4:
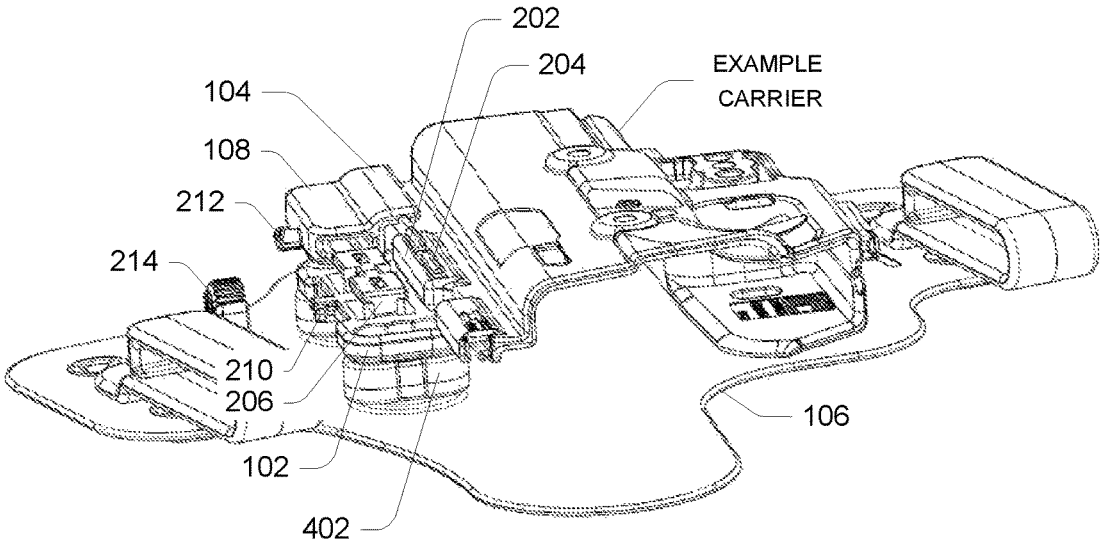
FIGS. 4 and 5 show a further expanded view of the example holster configuration of FIG. 1, according to an implementation.
Figure 5:
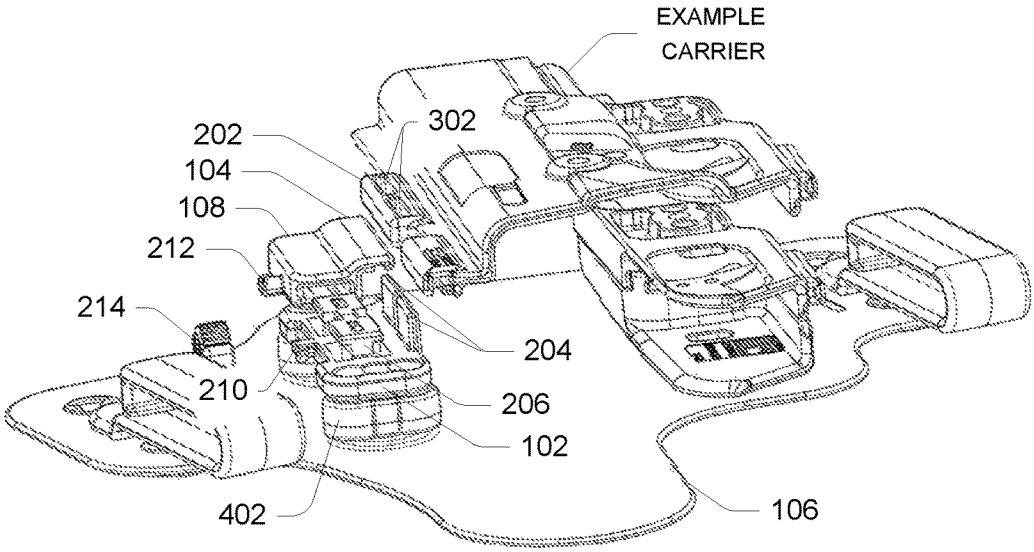
Figure 6:
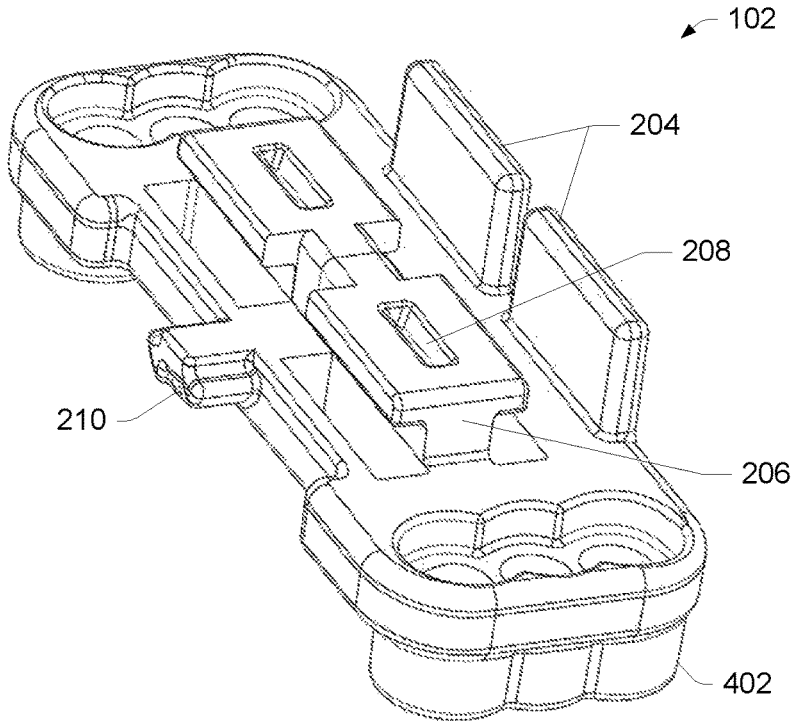
FIG. 6 shows a perspective view of an example male latch support component, according to an implementation.

Representative implementations of devices and techniques provide a backer latch attachment system for various field-adaptable holster arrangements (such as for handgun holsters or other implement holsters, for example). In the implementations, the backer latch attachment may be used to couple various holster components (holster shell, belt clip, belt strap adapter, paddle, modular coupler, etc.) together and/or to a holster backer to form holsters in various configurations. For example, the backer latch attachment system may be employed by a user to form various user-convertible holster configurations, such as inside the waistband (IWB) holsters, outside the waistband (OWB) holsters, and other carry configurations of holsters, by interchanging and coupling components using the backer latch attachment.

In various implementations, the backer latch attachment may be temporarily or permanently fixed to a holster backer (or to a paddle, a modular coupler, a strap, a belt slide, and so forth). In the implementations, the backer latch attachment engages one or more features (such as a latch device) on a holster shell or cover, and couples the holster shell to the backer at least in part by the features. The backer latch attachment securely grips the features, coupling various components to the holster shell via the features and the backer latch attachment. One or more lock mechanisms may be used to lock the holster features to the backer latch attachment, until intentionally released by the user.

Techniques and devices are discussed with reference to example handgun holsters illustrated in the figures. However, this is not intended to be limiting, and is for ease of discussion and illustrative convenience. The techniques and devices discussed may be applied to a holster or to any of various cases, carriers, containers, implements, tools, objects, and the like, and remain within the scope of the disclosure. For the purposes of this disclosure, the generic term "carrier" is used to indicate any or all of the above.

Further, the shape and quantity of the backer latch components illustrated in the figures may vary to accommodate the various objects to be coupled, as well as to accommodate various applications. In alternate embodiments, fewer, additional, or alternate components may be used and/or combined to form a backer latch having an equivalent function and operation.

Implementations are explained in more detail below using a plurality of examples. Although various implementations and examples are discussed here and below, further implementations and examples may be possible by combining the features and elements of individual implementations and examples.

Example Embodiments

An example backer latch attachment ("backer latch") 100, as shown in FIGS. 1-15, allows for a carrier (such as an implement or an implement holster, for example) to be coupled to additional holster components and/or to a holster backer 106, using a feature, such as a latch 202, for example, provided on the carrier. As shown in FIGS. 1-15, in various implementations, a backer latch 100 includes a male latch support 102 arranged to receive the feature 202 (e.g., latch) of the carrier and a lock cover 104 arranged to temporarily or permanently lock the feature 202 to the male latch support 102. The feature 202 is trapped between the male latch support 102 and the lock cover 104, coupling the carrier (e.g., holster shell) to the backer 106 securely, until intentionally released by the user. The backer latch 100 can also couple additional components to the carrier or to the backer 106, as desired. In various embodiments, the backer latch 100 may include various other components as described herein and below, for convenience and for accommodating various applications.

Referring to FIGS. 1-15, in various embodiments, the male latch support 102 is coupled to the backer 106 using temporary or permanent fasteners (fasteners are not shown) via attachment holes 112 in the male latch support 102. The male latch support 102 may include one or more spacers 402 (see FIG. 4) to adjust or customize a height of the male latch support 102 above a surface of the backer 106, to accommodate various applications, for example. The male latch support 102 is formed to mate with one or more features 202 of the carrier. In various implementations, the male latch support 102 and the features 202 on the carrier may have a different shape, size, etc. than those illustrated, but are still adapted to mate with each other.

In various embodiments, the male latch support 102 includes one or more latch fins 204 arranged to engage the feature 202 of the carrier. In some embodiments, the carrier feature 202 includes one or more recesses or openings 302 that may be engaged by the latch fins 202. For example, the latch fins 202 can insert into the openings 302 to hold the feature 202, and thus, the carrier. In an embodiment, when attaching the carrier to the backer 106, the carrier is positioned over the backer 106 and the male latch support 102 so that the latch fins 204 are inserted into the one or more openings 302 in the carrier.

In various implementations, the male latch support 102 includes a first half 206 of a sliding coupler. A female lock cover 104 is slideably coupled onto the male latch support 102 using a second half 108 of the sliding coupler (see FIG. 8). In various embodiments, sliding couplers may have different interlocking shapes, allowing mated sliding coupler halves 108 and 206 to engage each other by sliding one coupler half 108 with respect to the other coupler half 206, forming a secure coupler.

Figure 7:
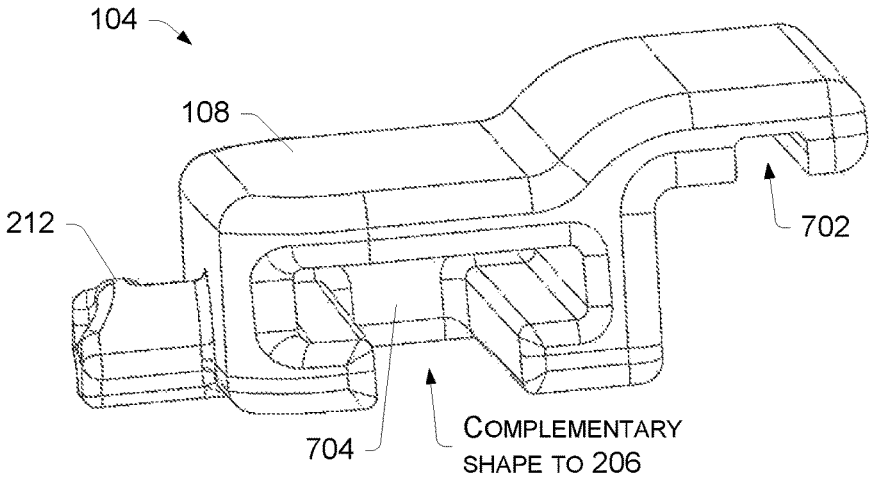
FIG. 7 shows a perspective view of an example lock cover, according to an implementation.
Figure 8:
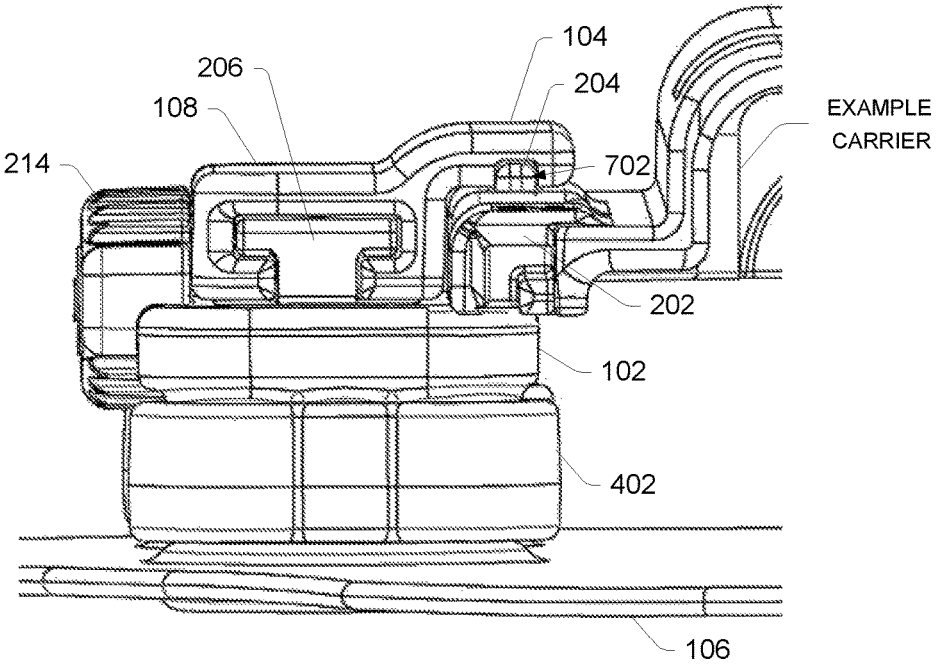
FIG. 8 shows a detail view of an example lock cover coupled to an example male latch support, according to an implementation.
Figure 9:
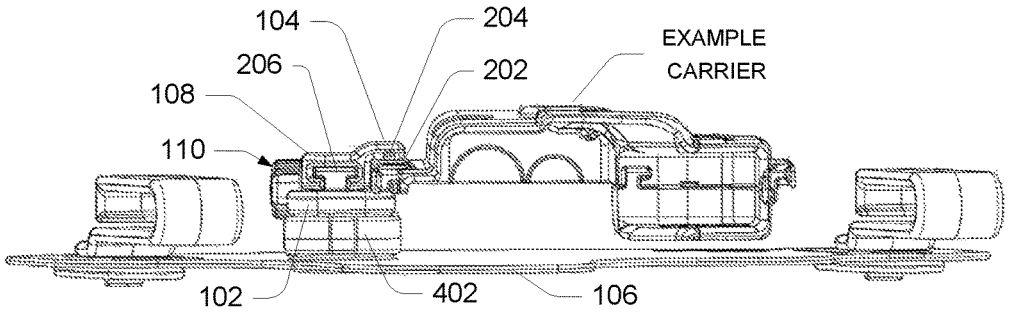
FIG. 9 shows a top view of the example holster configuration of FIG. 1, with the example backer latch attachment, according to an implementation.

For example, in an implementation, as shown in FIGS. 2-6, for example, the male latch support 102 includes the male sliding coupler half 206, having a cross-sectional shape (e.g., such as a "T", "I", "V", inverted "L", etc.) to engage the lock cover 104. In the implementation, as shown in FIGS. 7-9, for example, the lock cover 104 is coupled to the male latch support 102 by sliding the female sliding coupler half 108, having a complementary cross-sectional shape, over the male sliding coupler half 206. For example, the female sliding coupler half 108 is integral to or coupled to the lock cover 104.

In the implementation, sliding the female sliding coupler 108 over the male sliding coupler 206 couples the lock cover 104 to the male latch support 102, thereby covering the latch fins 204 with the lock cover 104 and trapping the feature 202 (e.g., latch 202) on the male latch support 102 (see FIG. 8, for example). In an example, as shown in FIGS. 7 and 8, the lock cover 104 may include a detent or recess 702 configured to fit over the latch fins 204, for securing the feature 202 of the carrier on the latch fins 204.

In an embodiment, as shown in FIG. 7, the female sliding coupler 108 may include a barrier or wall 704, which can form a stop for the female sliding coupler 108, to indicate when the female sliding coupler 108 is fully engaged on the male sliding coupler 206. In another embodiment, the male sliding coupler 206 includes one or more detents, recesses, or openings 208 which may be engaged by the female sliding coupler 108, which may include one or more bumps, tabs, or the like (not shown), to provide tactile feedback, or to help secure the female sliding coupler 108 to the male sliding coupler 206. In alternate implementations, the male sliding coupler 206 and the female sliding coupler 108 may have different shapes, sizes, or forms than illustrated, and remain capable of engaging one another to trap the feature 202 of the carrier. In other implementations, other connection techniques (e.g., snaps, guides, clips, fasteners, etc.) may also be used to couple the lock cover 104 to the male latch support 102.

Referring to FIGS. 1-15, in various implementations, an additional locking mechanism 110 may be used to lock the female lock cover 104 to the male latch support 102, and to prevent the female lock cover 104 from moving with respect to the male latch support 102 unintentionally. In the implementations, the locking mechanism 110 may have different forms or shapes or use different techniques. For instance, as shown in FIGS. 1-15, a twist lock mechanism may be used as a locking mechanism 110.

Figure 11:
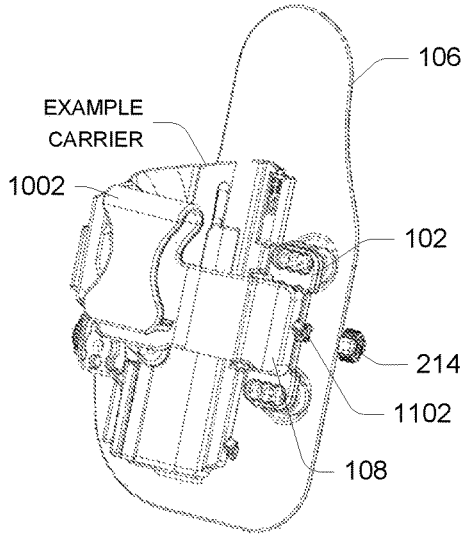
Figure 14:
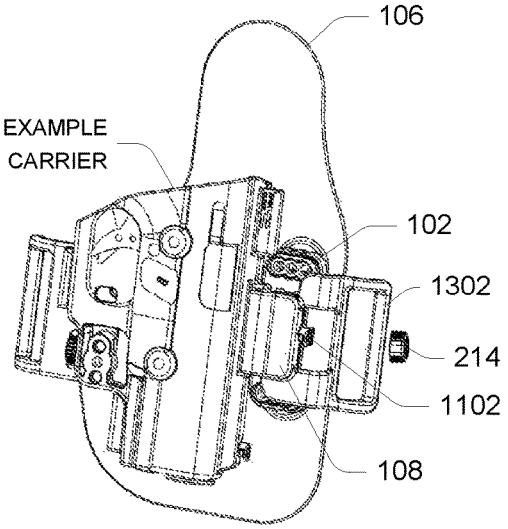

In an implementation, as shown in FIGS. 2-7, for instance, the male latch support 102 includes a first portion 210 of a male lock component 1102 (as shown in FIGS. 11 and 14) and the female lock cover 104 includes a second portion 212 of the male lock component 1102. When the female lock cover 104 is joined to the male latch support 102, the two portions 210 and 212 align and form the male lock component 1102. In an embodiment, a twist cap 214 (or the like) can be fit over the male lock component 1102, keeping the two portions 210 and 212 together and thus, keeping the female lock cover 104 joined to the male latch support 102, and preventing the female lock cover 104 from unintentionally moving with respect to the male latch support 102. In alternate embodiments, other twist lock mechanisms may be used (e.g., having a ring instead of a cap 212, including more male lock component 1102 portions, and so forth) or other types of locking mechanisms 110 may be used to prevent the female lock cover 104 from unintentionally moving with respect to the male latch support 102.

To separate the female lock cover 104 from the male latch support 102, the lock mechanism 110 (e.g., the cap 214) is removed first. The female sliding coupler 108 is slid away from the male sliding coupler 206 and the lock cover 104 removed from the male latch support 102. The feature 202 is lifted off of the latch fins 204 of the male latch support 102. The carrier may then be removed from the male latch support 102 and the backer 106 for cleaning, reconfiguration, or the like. The user may re-assemble the holster arrangement in a similar configuration (as shown in FIGS. 1-5), or in another configuration as desired using the male latch support 102, a backer 106 or other carry component, and a variation of the female lock cover 104 (as shown in FIGS. 10-15, for example).

Different variations of female lock covers 104 are available, depending on the carry configuration desired, as well as different holster components that may be coupled to the carrier or backer 106. As shown in FIGS. 1-15, in various embodiments, multiple components may be joined and locked in the joined configuration using a male latch support 102 and a female lock cover 104.

In the configurations illustrated herein, FIGS. 1-5 show the female lock cover 104 as a standalone piece (with an integral or coupled female sliding coupler half 108) to form an inside-the-waistband (IWB) carry holster configuration, for example. In various embodiments, the holster components form a clip-on holster that can be worn in an IWB carry configuration, or the like.

Figure 10:
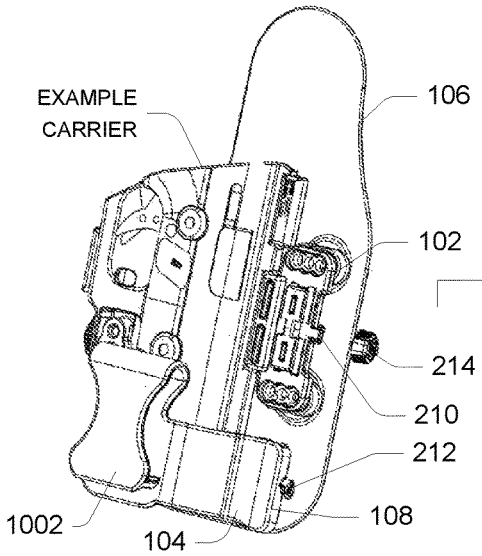
FIGS. 10-12 show perspective views of an example holster configuration with an example backer latch attachment, according to an implementation.
Figure 12:
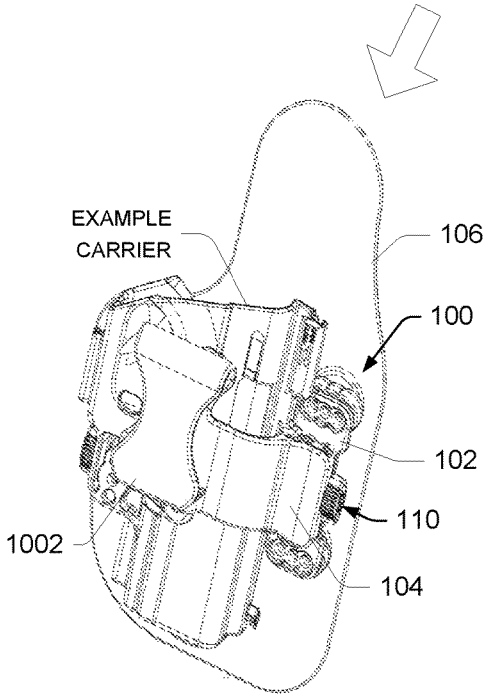
Figure 13:
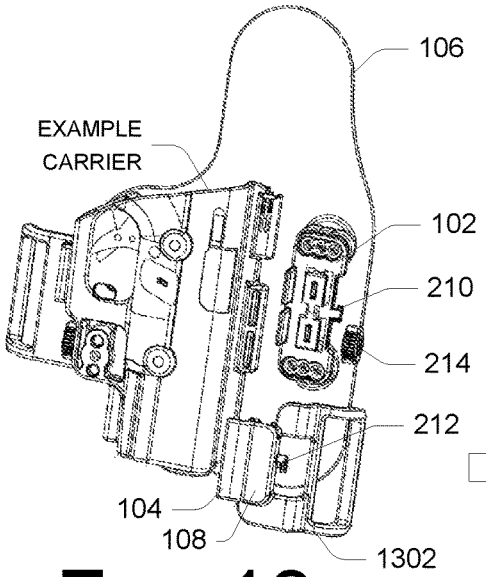
FIGS. 13-15 show perspective views of another example holster configuration with an example backer latch attachment, according to an implementation.
Figure 15:
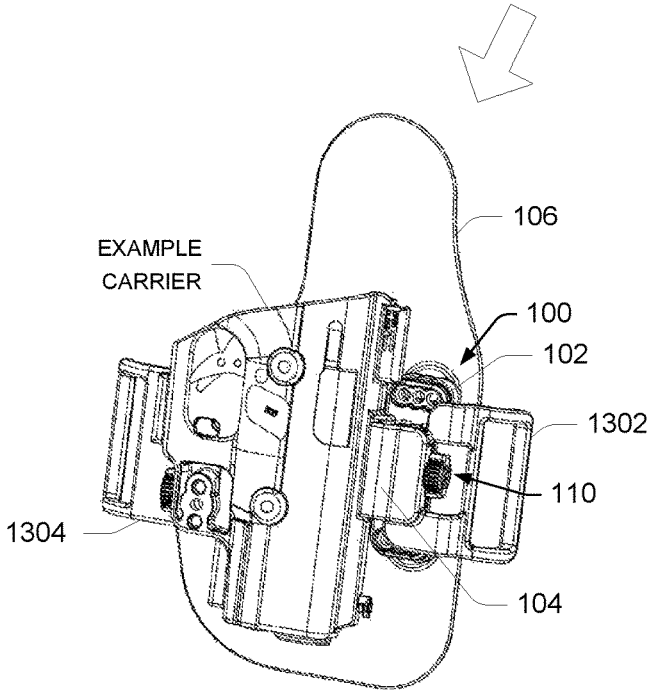

FIGS. 10-12 show the female lock cover 104 (with an integral or coupled female sliding coupler half 108) integral to an appendix clip 1002 for clip-on IWB carry, for example. FIGS. 13-15 show the female lock cover 104 integral to a belt slide 1302 for outside-the-waistband (OWB) carry, for example (a second belt slide 1304 may also be attached to the backer 106 or the carrier as shown in FIG. 15). In other embodiments, the configurations shown may be used for alternate carry arrangements (e.g., shoulder, pocket, boot, purse, etc.). Also, many other attachment components, such as clips, paddles, couplers, slides, etc. may be attached to or integral with the female lock cover 104 for a variety of carry or storage configurations.

As described above, to release the carrier from the male latch support 102 and backer 106, a user removes the lock device 110 and slides the female lock cover 104 off of the male latch support 102.

In various implementations, components of the backer latch 100 are comprised of various plastics, composites, metals, combinations of the same, or the like. For example, the male latch support 102 and/or the lock cover 104 may be comprised of a polyamide, or similar material. For example, the backer latch 100 components may be injection molded, stamped, formed, or the like. In various embodiments, the backer latch 100 components have rigidity and stability properties based on a particular material selected for the backer latch 100 components. For example, some materials that may be used include styrenic block copolymers (TPE-s), polyolefin blends (TPE-o), elastomeric alloys (TPE-v or TPV), thermoplastic polyurethanes (TPU), Thermoplastic copolyesters, thermoplastic polyamides, various metals and alloys, fiber composites, combinations of the same, and the like. Additionally, in some embodiments, the stability properties are also based on a thickness of the backer latch 100 components.

In various implementations, the backer latch 100 may include fewer, more, or alternate components, and remain within the scope of the disclosure. In various embodiments, the shape and configuration of the backer latch 100 components may vary to accommodate different implements or applications. In an example, the male latch support 102 and/or lock cover 104 may be formed to closely fit a particular implement. In other examples, the male latch support 102 and/or lock cover 104 may be more generally formed to fit multiple implements. For instance, carriers may include different carrier feature (e.g., latch 702) designs, shapes, and sizes.

The illustrations of FIGS. 1-15 are not intended to be limiting. In the various example embodiments illustrated in FIGS. 1-15, the location and position of the components, locking mechanisms, and the like are for example only. Other locations and positions are contemplated and are within the scope of this disclosure. In some cases, additional or alternative components, techniques, sequences, or processes may be used to implement the techniques described herein. Further, the components and/or techniques may be arranged and/or combined in various combinations, while resulting in similar or approximately identical results. It is to be understood that a backer latch 100 may be implemented as a stand-alone system or as part of another arrangement (e.g., integrated with other components). In various implementations, additional or alternative components may be used to accomplish the disclosed techniques and arrangements.

While a carrier in the form of a handgun holster is illustrated, various other types of implements, implement holsters, cases, containers, and the like are also within the scope of the disclosure, and intended to be mounted using the backer latch 100. Further, the design of the backer latch 100 as well as the design of the various attachment devices may vary. Other attachment devices and techniques are also within the scope of the disclosure.

Although various implementations and examples are discussed herein, further implementations and examples may be possible by combining the features and elements of individual implementations and examples.

Conclusion

Although the implementations of the disclosure have been described in language specific to structural features and/or methodological acts, it is to be understood that the implementations are not necessarily limited to the specific features or acts described.

What is claimed is:

1. An apparatus, comprising:

a male latch support including:

one or more latch components adapted to receive a feature of a carrier, the one or more latch components configured to mate with the feature of the carrier; and a first coupler; and a female lock cover removably coupled to the male latch support and adapted to secure the feature of the carrier to the one or more latch components when the female lock cover is coupled to the male latch support, the female lock cover including:

a first portion configured to overlap one or more of the latch components when the female lock cover is coupled to the male latch support; and a second coupler configured to engage the first coupler to removably couple the female lock cover to the male latch support.

2. The apparatus of claim 1, further comprising a locking mechanism removably coupled to the male latch support and the female lock cover and configured to prevent the female lock cover from unintentionally moving with respect to the male latch support.

3. The apparatus of claim 2, wherein the locking mechanism comprises a first portion of a lock component comprising a portion of the male latch support, a second portion of the lock component comprising a portion of the female lock cover, and a third component configured to secure the first portion of the lock component to the second portion of the lock component.

4. The apparatus of claim 3, wherein the first portion of the lock component is joined to the second portion of the lock component when the female lock cover is coupled to the male latch support.

5. The apparatus of claim 1, further comprising a detent or recess in the first portion of the female lock cover configured to fit a shape of the one or more latch components.

6. The apparatus of claim 1, further comprising a belt clip or a belt slide integral to or coupled to the female lock cover.

7. The apparatus of claim 1, wherein the one or more latch components have a perimeter shape and a size configured to mate with a shape and a size of the feature of the carrier.

8. The apparatus of claim 1, wherein the first coupler and the second coupler comprise complementary couplers, and wherein the second coupler is configured to engage the first coupler by sliding a portion of the second coupler with respect to the first coupler.

9. The apparatus of claim 1, wherein the first coupler and the second coupler have interlocking shapes configured to engage each other to secure the female lock cover to the male latch support.

10. The apparatus of claim 1, wherein the first portion of the female lock cover is configured to trap the feature of the carrier between the male latch support and the female lock cover.

11. A holster for an implement, comprising:

a carrier adapted to enclose at least a portion of the implement, the carrier including a feature;

a backer;

a male latch support attached to the backer and configured to couple the carrier to the backer, the male latch support including one or more latch components adapted to receive the feature; and a female lock cover adapted to be removably coupled to the male latch support, the female lock cover including a first portion arranged to overlap one or more of the latch components and arranged to secure the feature to the one or more latch components when the female lock cover is coupled to the male latch support.

12. The holster of claim 11, further comprising one or more locking mechanisms arranged to prevent the female lock cover from unintentionally moving with respect to the male latch support when the female lock cover is coupled to the male latch support.

13. The holster of claim 11, wherein the one or more locking mechanisms includes a first portion of a male lock component comprising a portion of the male latch support, a second portion of the male lock component comprising a portion of the female lock cover, and a third portion configured to secure the first portion of the male lock component to the second portion of the male lock component.

14. The holster of claim 11, further comprising one or more sliding couplers arranged to engage and secure the female lock cover to the male latch support when the female lock cover is slid with respect to the male latch support, the one or more sliding couplers including a first portion integral to the male latch support and a second portion integral to the female lock cover.

15. The holster of claim 11, wherein the female lock cover includes an integral belt clip or an integral belt slide.

16. A method for coupling an implement carrier to a backer, the carrier including a feature, the method comprising:

attaching a male latch support to the backer, the male latch support including one or more latch components adapted to receive the feature of the carrier;

mating the feature of the carrier to the one or more latch components;

removably coupling a female lock cover to the male latch support, including overlapping one or more of the latch components with a first portion of the female lock cover; and securing the feature of the carrier to the one or more latch components with the female lock cover.

17. The method of claim 16, further comprising preventing the female lock cover from unintentionally moving with respect to the male latch support with one or more locking mechanisms.

18. The method of claim 17, further comprising forming the one or more locking mechanisms by securing a first portion of the male latch support to a second portion of the female lock cover with a third securing component.

19. The method of claim 16, further comprising sliding a first portion of the female lock cover with respect to a second portion of the male latch support to removably couple the female lock cover to the male latch support.

20. The method of claim 16, further comprising integrating a belt clip or a belt slide with the female lock cover.

* * * * *